US008936013B2

(12) United States Patent
Fleck

(10) Patent No.: US 8,936,013 B2
(45) Date of Patent: Jan. 20, 2015

(54) ENGINE HAVING PCV SEPARATOR INLET SHIELDED BY HEAD GASKET GEOMETRY

(71) Applicant: GM Global Technology Operations LLC, Detroit, MI (US)

(72) Inventor: Michael B. Fleck, Royal Oak, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 150 days.

(21) Appl. No.: 13/776,773

(22) Filed: Feb. 26, 2013

(65) Prior Publication Data

US 2014/0238365 A1 Aug. 28, 2014

(51) Int. Cl.
*F01M 13/00* (2006.01)

(52) U.S. Cl.
USPC ..... 123/572; 277/591

(58) Field of Classification Search
USPC ..... 123/572–574, 41.86; 277/591
See application file for complete search history.

(56) References Cited

U.S. PATENT DOCUMENTS 6,234,154 B1 * 5/2001 Spix ..... 123/572

* cited by examiner

*Primary Examiner* — Noah Kamen
(74) *Attorney, Agent, or Firm* — Quinn Law Group, PLLC

(57) ABSTRACT

An engine includes an engine block that defines a drain-back passage and a Positive Crankcase Ventilation (PCV) passage. The drain-back passage and the PCV passage are disposed in fluid communication with each other. A cylinder head is attached to the engine block. The cylinder head defines an oil return passage. The oil return passage is disposed in fluid communication with both the drain-back passage and the PCV passage. A head gasket is disposed between the engine block and the cylinder head, and includes a shelf that extends at least partially over the PCV passage to prevent liquids draining through the oil return passage into the drain-back passage, from entering the PCV passage, while allowing gasses flowing through the oil return passage to enter the PCV passage.

16 Claims, 2 Drawing Sheets

ENGINE HAVING PCV SEPARATOR INLET SHIELDED BY HEAD GASKET GEOMETRY

TECHNICAL FIELD

The invention generally relates to an internal combustion engine.

BACKGROUND

Internal combustion engines typically include an engine block having a cylinder head attached to the engine block. A head gasket is disposed between the engine block and the cylinder head. The cylinder head defines an oil return passage for returning oil from the cylinder head back to an oil sump, through a drain-back passage defined by the engine block. The engine block may further define a Positive Crankcase Ventilation (PCV) passage that is in fluid communication with both the oil return passage and the drain-back passage. The PCV passage communicates gasses from the oil return passage to a PCV separator chamber that is defined by the internal combustion engine. The oil return passage of the cylinder head is disposed vertically above the PCV passage and the drain-back passage, which allows oil draining from the oil return passage into the drain-back passage to inadvertently drain into the PCV passage, and thereby into the PCV separator chamber.

SUMMARY

An internal combustion engine is provided. The internal combustion engine includes an engine block that defines a drain-back passage and a Positive Crankcase Ventilation (PCV) passage. The drain-back passage and the PCV passage are disposed in fluid communication with each other. A cylinder head is attached to the engine block. The cylinder head defines an oil return passage. The oil return passage is disposed in fluid communication with both the drain-back passage and the PCV passage. A head gasket is disposed between the engine block and the cylinder head. The head gasket includes a shelf that extends at least partially over the PCV passage to prevent liquids draining through the oil return passage into the drain-back passage from entering the PCV passage, while allowing gasses flowing through the oil return passage to enter the PCV passage.

An engine assembly is also provided. The engine assembly includes an engine block that defines, an oil sump, a Positive Crankcase Ventilation (PCV) chamber, a drain-back passage and a Positive Crankcase Ventilation (PCV) passage. A cylinder head is attached to the engine block. The cylinder head defines an oil return passage. A head gasket is disposed between the engine block and the cylinder head. The drain-back passage connects the oil return passage and the oil sump in fluid communication. The PCV passage connects the oil return passage and the PCV separator chamber in fluid communication. The drain-back passage and the PCV passage are disposed in fluid communication with each other. The engine block includes a head surface that is disposed against the head gasket. The engine block defines an inlet chamber that is recessed into the head surface, with the PCV passage having an opening into the inlet chamber. The inlet chamber interconnects the PCV passage, with the drain-back passage and the oil return passage, in fluid communication. The head gasket includes a shelf that at least partially spans across the inlet chamber to shield the opening of the PCV passage into the inlet chamber. The shelf prevents liquids draining through the oil return passage into the drain-back passage, from entering the PCV passage, while allowing gasses flowing through the oil return passage to enter the PCV passage.

Accordingly, the shelf in the head gasket prevents liquids, e.g., engine oil from draining into the PCV passage from the oil return passage, and thereby reduces engine oil buildup in the separator chamber. Reducing engine oil buildup in the separator chamber reduces the amount of engine oil that must be separated and drained from the PCV separator chamber.

The above features and advantages and other features and advantages of the present invention are readily apparent from the following detailed description of the best modes for carrying out the invention when taken in connection with the accompanying drawings.

DETAILED DESCRIPTION

Figure 1:
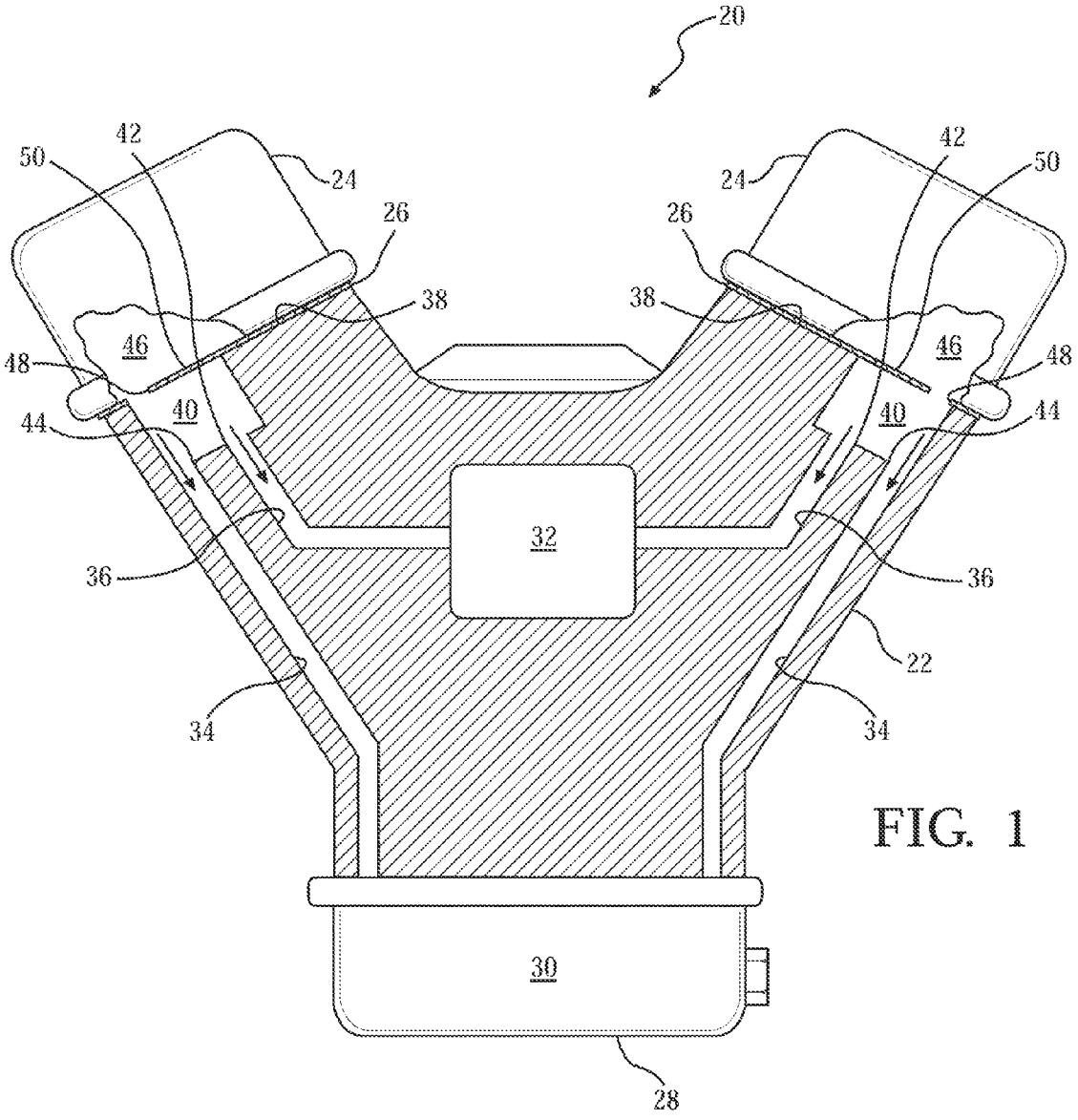
FIG. 1 is a schematic cross sectional view of an internal combustion engine.
Figure 2:
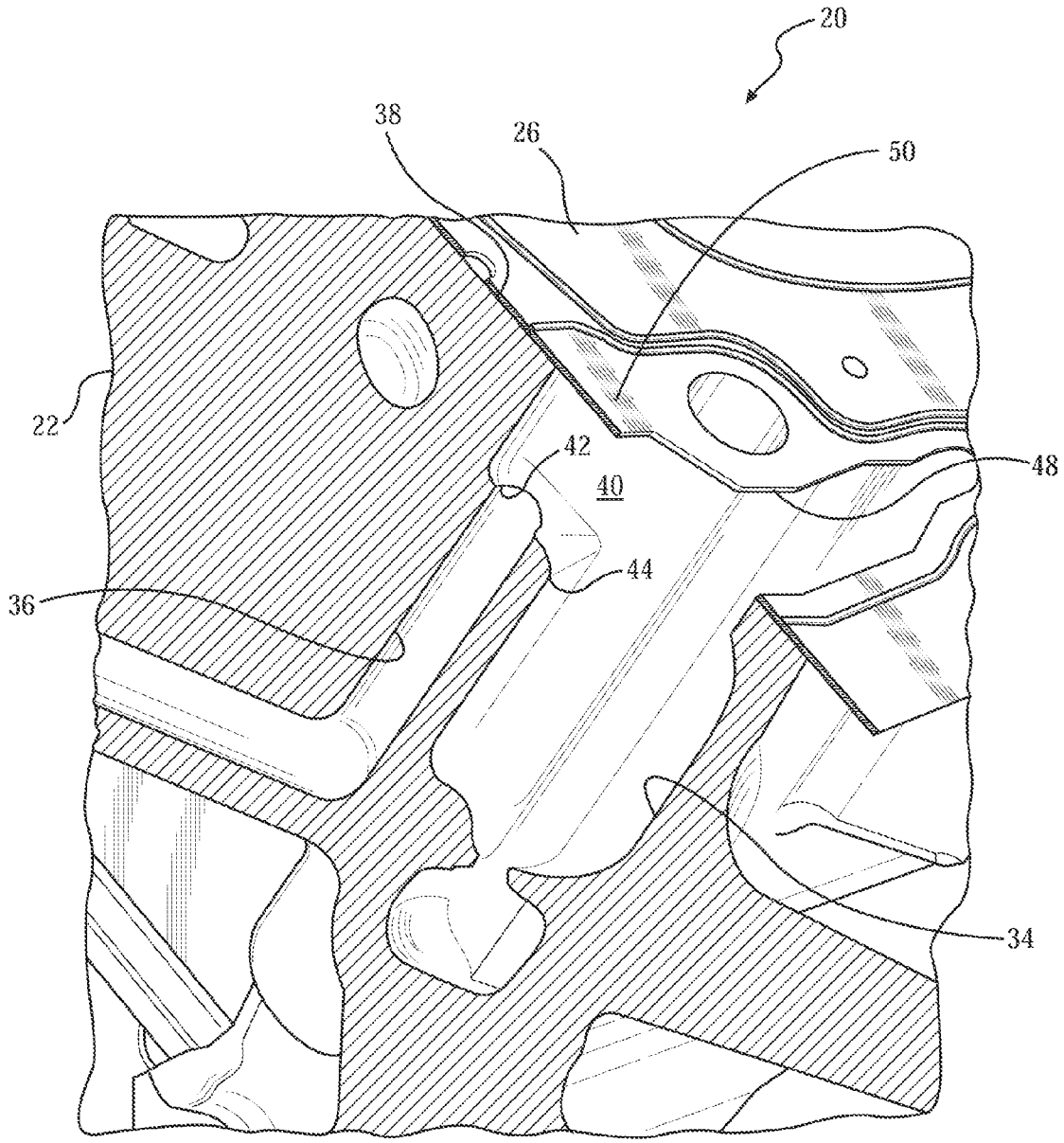
FIG. 2 is a schematic fragmentary cross sectional perspective view of a head gasket disposed on a head surface of an engine block of the internal combustion engine.

Those having ordinary skill in the art will recognize that terms such as "above," "below," "upward," "downward," "top," "bottom," etc., are used descriptively for the figures, and do not represent limitations on the scope of the invention, as defined by the appended claims. Furthermore, the invention may be described herein in terms of functional and/or logical block components and/or various processing steps. It should be realized that such block components may be realized by any number of hardware, software, and/or firmware components configured to perform the specified functions.

Referring to the Figures, wherein like numerals indicate like parts throughout the several views, an engine assembly, i.e., an internal combustion engine, is generally shown at 20. As shown, the internal combustion engine 20 is configured as a V-style engine. However, it should be appreciated that the internal combustion engine 20 may be configured as some other style of engine.

The internal combustion engine 20 includes an engine block 22 having a cylinder head 24 attached to the engine block 22. A head gasket 26 is disposed between the engine block 22 and the cylinder head 24. An oil pan 28 may be attached to the engine block 22 to define an oil sump 30 of the engine block 22. The oil sump 30 stores a supply of engine oil for use by the internal combustion engine 20 as is known. The engine block 22 further defines a Positive Crankcase Ventilation (PCV) chamber 32, a drain-back passage 34 and a Positive Crankcase Ventilation (PCV) passage 36. The PCV chamber is operable to separate engine oil suspended within gasses of the internal combustion engine as is known in the art. The PCV passage 36 is disposed in fluid communication with the PCV chamber 32. The drain-back passage 34 is disposed in fluid communication with the oil sump 30.

The engine block 22 includes a head surface 38. The head surface 38 of the engine block 22 is disposed against the head gasket 26. The cylinder head 24 is attached to the head surface 38, with the head gasket 26 disposed between the head surface 38 and the cylinder head 24. The engine block 22 defines an inlet chamber 40 that is recessed into the head surface 38. The PCV passage 36 includes an opening 42 into the inlet chamber 40, and the drain-back passage 34 also includes an opening 44 into the inlet chamber 40. The opening 42 of the PCV passage 36 into the inlet chamber 40, and the opening 44 of the drain-back passage 34 into the inlet chamber 40, are each vertically spaced below the head surface 38. The inlet chamber 40 interconnects the PCV passage 36 with the drain-back passage 34 in fluid communication.

The cylinder head 24 defines an oil return passage 46. The oil return passage 46 is in fluid communication with the drain-back passage 34, and is in fluid communication with the PCV passage 36 through the inlet chamber 40. The drain-back passage 34 connects the oil return passage 46 and the oil sump 30 in fluid communication. The PCV passage 36 connects the oil return passage 46 and the PCV separator chamber in fluid communication. The oil return passage 46 is disposed vertically above the inlet chamber 40, the opening 42 of the PCV passage 36 into the inlet chamber 40, and the drain-back passage 34. The head gasket 26 defines an aperture 48 allowing fluids to pass from the oil return passage 46 of the cylinder head 24, into the drain-back passage 34 and/or the PCV passage 36 through the inlet chamber 40.

The head gasket 26 includes a shelf 50 that at least partially spans across the inlet chamber 40. The shelf 50 of the head gasket 26 shields the opening 42 of the PCV passage 36 into the inlet chamber 40 from engine oil that is draining down through the oil return passage 46 of the cylinder head 24 into the drain-back passage 34. Accordingly, the shelf 50 prevents or reduces liquids, e.g., engine oil, which is draining through the oil return passage 46 into the drain-back passage 34, from entering the PCV passage 36, while allowing gasses flowing through the oil return passage 46 to enter the PCV passage 36. As such, gasses of the internal combustion engine 20, which may contain engine oil suspended therein, may still flow through the inlet chamber 40, into the PCV passage 36, and into the PCV chamber 32, where the engine oil suspended within the gasses may be separated therefrom.

The shelf 50 at least partially extends across the opening 42 of the PCV passage 36, and preferably extends completely across the opening 42 of the PCV passage 36 to completely cover the opening 42 of the PCV passage 36 into the inlet chamber 40. Because the opening 42 of the PCV passage 36 into the inlet chamber 40 is vertically spaced below the head surface 38, and thereby vertically spaced below the shelf 50 of the head gasket 26, gasses flowing through the oil return passage 46 may flow around the shelf 50 and into the PCV passage 36.

Preferably, the shelf 50 of the gasket at least partially extends across the opening 44 of the drain-back passage 34 into the inlet chamber 40. Because the shelf 50 extends partially across the opening 44 of the drain-back passage 34 into the inlet chamber 40, the shelf 50 operates to direct engine oil that is draining from the oil return passage 46 of the cylinder head 24 into the drain-back passage 34, and not into the inlet chamber 40 or the PCV passage 36.

The detailed description and the drawings or figures are supportive and descriptive of the invention, but the scope of the invention is defined solely by the claims. While some of the best modes and other embodiments for carrying out the claimed invention have been described in detail, various alternative designs and embodiments exist for practicing the invention defined in the appended claims.

The invention claimed is:

1. An internal combustion engine comprising:

an engine block defining a drain-back passage and a Positive Crankcase Ventilation (PCV) passage, with the drain-back passage and the PCV passage disposed in fluid communication with each other;

a cylinder head attached to the engine block and defining an oil return passage, with the oil return passage disposed in fluid communication with both the drain-back passage and the PCV passage; and a head gasket disposed between the engine block and the cylinder head;

wherein the head gasket includes a shelf extending at least partially over the PCV passage to prevent liquids draining through the oil return passage into the drain-back passage from entering the PCV passage, while allowing gasses flowing through the oil return passage to enter the PCV passage.

2. An internal combustion engine as set forth in claim 1 wherein the engine block defines an oil sump and a PCV separation chamber, with the drain-back passage connecting the oil return passage and the oil sump in fluid communication, and with the PCV passage connecting the oil return passage and the PCV separator chamber in fluid communication.

3. An internal combustion chamber as set forth in claim 2 wherein the engine block includes a head surface disposed against the head gasket, and defines an inlet chamber recessed into the head surface, wherein each of the PCV passage, the drain-back passage and the oil return passage are in fluid communication with the inlet chamber, and wherein the inlet chamber connects the PCV passage and the drain-back passage in fluid communication.

4. An internal combustion engine as set forth in claim 3 wherein the PCV passage includes an opening into the inlet chamber that is spaced from the head surface.

5. An internal combustion engine as set forth in claim 4 wherein the opening of the PCV passage into the inlet chamber is vertically spaced below the head surface.

6. An internal combustion engine as set forth in claim 4 wherein the shelf of the gasket at least partially spans across the inlet chamber to shield the opening of the PCV passage.

7. An internal combustion engine as set forth in claim 6 wherein the shelf at least partially extends across the opening of the PCV passage.

8. An internal combustion engine as set forth in claim 6 wherein the shelf completely extends across the opening of the PCV passage.

9. An internal combustion engine as set forth in claim 6 wherein the drain-back passage includes an opening into the inlet chamber.

10. An internal combustion engine as set forth in claim 9 wherein the shelf of the gasket at least partially extends across the opening of the drain-back passage into the inlet chamber to direct liquids draining from the oil return passage of the cylinder head into the drain-back passage.

11. An engine assembly comprising:

an engine block defining, an oil sump, a Positive Crankcase Ventilation (PCV) chamber, a drain-back passage and a Positive Crankcase Ventilation (PCV) passage;

a cylinder head attached to the engine block and defining an oil return passage;

a head gasket disposed between the engine block and the cylinder head;

wherein the drain-back passage connects the oil return passage and the oil sump in fluid communication, the PCV passage connects the oil return passage and the PCV separator chamber in fluid communication, and wherein the drain-back passage and the PCV passage are disposed in fluid communication with each other;

wherein the engine block includes a head surface disposed against the head gasket, and defines an inlet chamber recessed into the head surface, with the PCV passage having an opening into the inlet chamber, and with the inlet chamber interconnecting the PCV passage with the drain-back passage in fluid communication, and with the inlet chamber interconnecting the PCV passage with the oil return passage in fluid communication; and wherein the head gasket includes a shelf at least partially spanning across the inlet chamber to shield the opening of the PCV passage into the inlet chamber to prevent liquids draining through the oil return passage into the drain-back passage from entering the PCV passage, while allowing gasses flowing through the oil return passage to enter the PCV passage.

12. An engine assembly as set forth in claim 11 wherein the opening of the PCV passage into the inlet chamber is vertically spaced below the head surface.

13. An engine assembly as set forth in claim 11 wherein the shelf at least partially extends across the opening of the PCV passage.

14. An engine assembly as set forth in claim 11 wherein the shelf completely extends across the opening of the PCV passage.

15. An engine assembly as set forth in claim 11 wherein the drain-back passage includes an opening into the inlet chamber.

16. An engine assembly as set forth in claim 15 wherein the shelf of the gasket at least partially extends across the opening of the drain-back passage into the inlet chamber to direct liquids draining from the oil return passage of the cylinder head into the drain-back passage.

* * * * *